United States Patent [19]

Kincaid

[11] 4,327,246

[45] Apr. 27, 1982

[54] ELECTRIC CABLES WITH IMPROVED SHIELDING MEMBERS

[75] Inventor: John W. Kincaid, Batavia, Ill.

[73] Assignee: Belden Corporation, Geneva, Ill.

[21] Appl. No.: 122,296

[22] Filed: Feb. 19, 1980

[51] Int. Cl.[3] ..... H01B 11/06; H01B 9/02

[52] U.S. Cl. ..... 174/36; 174/105 R; 174/107; 174/108; 174/115; 428/189; 428/344; 428/347; 428/354

[58] Field of Search ..... 174/32, 34, 36, 102 R, 174/103, 104, 105 R, 106 R, 107, 108, 109, 115, 117 R, 117 F, 117 A; 333/243; 361/304; 428/77, 189, 343, 344, 346, 347, 354

[56] References Cited

U.S. PATENT DOCUMENTS

| | | | |
|---|---|---|---|
| 2,919,390 | 12/1959 | Robinson et al. | 361/304 |
| 3,032,604 | 5/1962 | Timmons | 174/36 X |
| 3,274,329 | 9/1966 | Timmons | 174/108 X |
| 3,474,186 | 10/1969 | Hale | 174/109 X |

FOREIGN PATENT DOCUMENTS

| | | | |
|---|---|---|---|
| 1017696 | 9/1952 | France | 174/109 |

*Primary Examiner*—Laramie E. Askin

*Attorney, Agent, or Firm*—Fitch, Even, Tabin, Flannery & Welsh

[57] ABSTRACT

Improved shielding members and electric cable constructions which utilize these shielding members are described. Various configurations of the shielding members can be used to enclose a single cable circuit consisting of one or more conductors in two concentric metallic shielding layers fabricated from a single shielding member which provides excellent electrical isolation for the cable circuit. Generally, the shielding members comprise an elongated ribbon of insulating material and a pair of elongated foil strips arranged in parallel relationship with the ribbon. The foil strips are bonded to opposite sides of the ribbon and each has an elongated edge generally in alignment with opposite elongated edges of the ribbon. The selective use of layers of heat sensitive sealing material for sealing the shielding layers protects the cable circuits from moisture.

19 Claims, 6 Drawing Figures

ELECTRIC CABLES WITH IMPROVED SHIELDING MEMBERS

The present invention relates to electric cables with improved shielding members. For proper transmittal of small signals through an electric cable consisting of one or more individual cable circuits each containing one or more conductors, it is sometimes necessary to prevent the individual cable circuits from picking up extraneous voltages from one another or from neighboring electric circuits. If these extraneous voltages are not excluded, they often result in adverse operation of subsequent amplifying equipment. Such foreign or undesired voltages picked up by cable circuits may mask or even destroy the original signals. Therefore, in order to prevent extraneous voltages from being picked up by the cable circuits, it has been common practice to provide metallic shielding wrapped around the individual cables.

One type of metallic shielding commonly used comprises a metallic sleeve composed of copper braid for enveloping a cable, with the copper braid in turn covered with an insulating layer to prevent undesirable ground connections to the shielding. Shielding of this type is relatively expensive to manufacture and relatively bulky and unduly heavy.

Another type of metallic shield commonly used comprises an elongated metallic foil strip having one surface insulated. The shielding can be wrapped about a cable with the insulated surface facing in a direction so as to suitably insulate the metal of the strip and thereby prevent unwanted electrical connections thereto.

Accordingly, it is an object of the present invention to provide electrical cables which include improved shielding members.

Another object of the invention is to provide electric cables of the type described wherein a conductor is electrically isolated within two metallic shielding layers formed by wrapping a single shielding member about the conductor.

Other objects of the present invention in addition to those set forth above will become apparent to those skilled in the art from the following description taken in connection with the accompanying drawings wherein.

Very generally one embodiment of an electric cable constructed in accordance with the present invention comprises a cable circuit consisting of one or more conductors surrounded by an elongated shielding member. The shielding member comprises an elongated ribbon of insulating material and a pair of elongated foil strips arranged in a parallel relationship with the ribbon and being bonded to opposite sides of the ribbon, with each of the foil strips having an elongated edge generally in alignment with opposite elongated edges of the ribbon. The shielding member is wrapped circumferentially about the cable circuits in a generally parallel relationship forming two concentric, substantially closed shielding layers with each of the layers formed by one of the foil strips.

Figure 1:
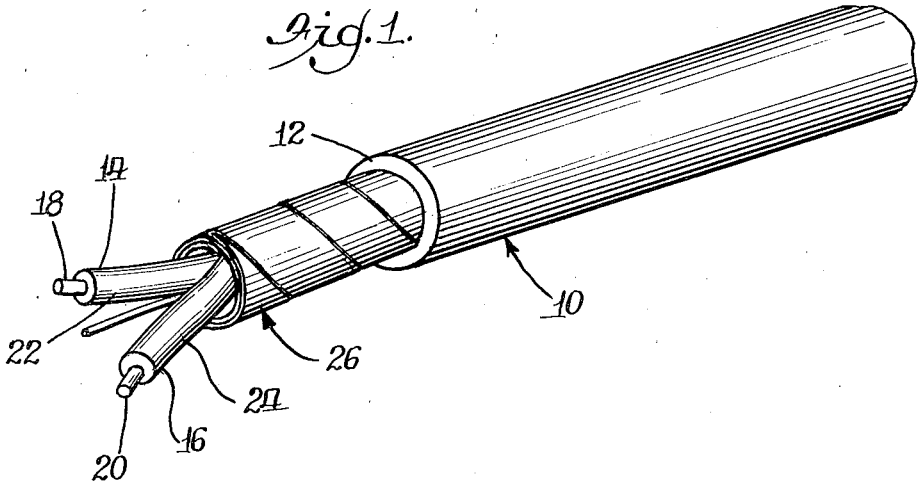
FIG. 1 is a perspective view of an electrical cable formed in accordance with the present invention with a portion of the outer jacket stripped from the inner shielding and insulated conductors.

More specifically, in FIG. 1 an electric cable 10 is shown which is utilized to transmit electrical signals in applications such as servomechanism systems, audio systems, etc. A portion of an outer insulation jacket 12 has been removed from the electric cable 10 for illustration purposes. The core of the electric cable 10 comprises a pair of insulated conductors 14 and 16 each including solid or stranded wires 18 and 20 covered in the conventional manner with insulating sleeves 22 and 24 respectively of a material such as rubber, plastic, etc. The conductors 14 and 16 represent a single cable circuit, are preferably helically twisted about each other, and are wrapped in an elongated shielding member 26. The conductors are preferably helically twisted about each other because this configuration affords better interference isolation characteristics and because a pair of conductors twisted about themselves retain their shape. The shielding member 26 is wrapped circumferentially around the conductors 14 and 16 in a helical configuration forming two concentric, substantially closed shielding tubes within which the conductors are encased.

Figure 2:
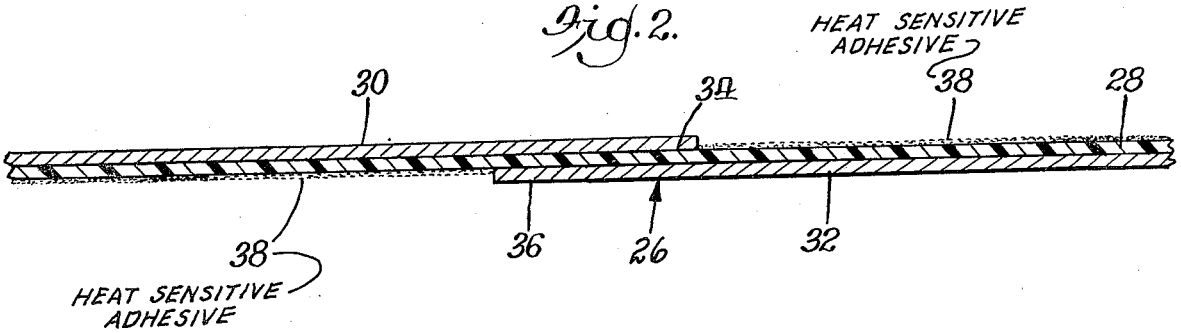
FIG. 2 is a sectional view of one form of shielding member employed in cable structures of the present invention.
Figure 3:
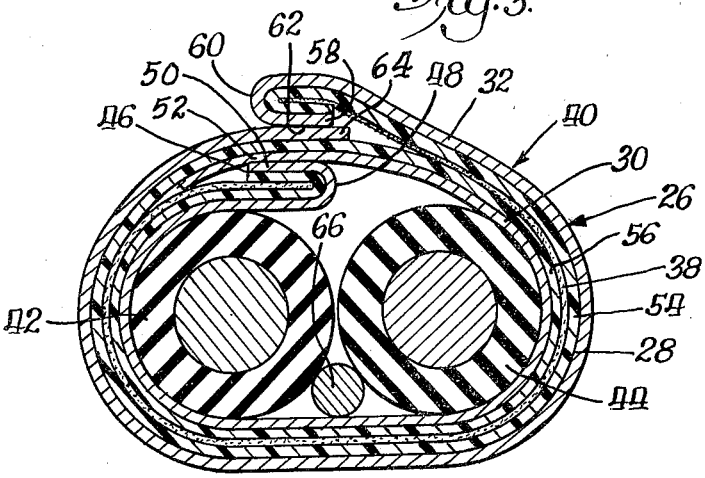
FIG. 3 is a cross-sectional view of an electric cable containing the shielding member in FIG. 2.

In accordance with the present invention a cross-sectional view of the shielding member 26 is shown in FIG. 2. The shielding member 26 comprises a ribbon 28 of insulating material fabricated from a suitable material such as polyethylene terephthalate resin, sold under the trademark "Mylar," tetrafluoroethylene polymer, sold under the trademark "Teflon," vinyl polyethylene, etc. A pair of foil strips 30 and 32 which are fabricated from any of the conducting materials such as copper, aluminum or silver are arranged in a parallel relationship with the ribbon 28, and are each bonded to an opposite side of the ribbon 28 and each has an outer elongated edge generally in alignment with opposite elongated edges of the ribbon 28. Preferably the foil strips are of a width slightly larger than half of the width of the insulating ribbon 28 so that the inner elongated edges 34 and 36 of the foil strips 30 and 32 overlap. This is desirable because it minimizes the amount of material necessary to surround a cable circuit. The exposed surfaces of the ribbon 28 are coated with a heat sensitive sealing material 38 which preferably bonds the ribbon to itself but not to the outer jacket or the inner core of the electric cable. Referring to FIG. 3 a cross-sectional view of an electric cable 40 is shown which includes the shielding member 26. It is noted that for illustration purposes the outer insulation jacket is not shown. The shielding member 26 forms two concentric electrically closed shielding layers preferably helically twisted about a cable circuit comprising a pair of insulated conductors 42 and 44. An outer elongated edge 46 of the shielding member 26 has a shorting fold 48 with an outer elongated edge 50 of the foil strip 30 turned outward. The shielding member 26 then wraps completely around the pair of conductors 42 and 44 with the foil strip 30 facing inward. An inner elongated edge 52 of the foil strip 30 contacts and is held snugly to the outer elongated edge 50 thereby forming a first metallic shield which completely surrounds the pair of conductors 42 and 44.

From this point the shielding member 26 wraps around the pair of conductors 42 and 44 a second time with one portion 54 of the ribbon 28 touching and bonded to another portion 56 of the ribbon 28 by the sealing material 38. The other outer elongated edge 58 of the shielding member 26 is folded under in a shorting fold 60 so that an outer elongated edge 62 of the foil strip 32 contacts an inner elongated edge 64 of the foil strip 32 thereby forming a second metallic shield which also completely surrounds the pair of conductors 42 and 44.

Located within the inner shielding layer and along the length of the cable 40 is a drain wire 66 which is fabricated from an uninsulated wire conductor preferably of solid material. The drain wire 66 is used to provide an easier means to terminate the ground of the cable. Further, since the foil strips have a high D.C. resistance, having the drain wire 66 in contact with the foil strips along the length of the cable 40 reduces the D.C. resistance of the cable ground.

It is noted that since the foil strips 30 and 32 are preferably spirally wrapped around the conductors 14 and 16 as shown in FIG. 1, at certain frequencies each of the metallic strips acts as an inductance, each turn of the foil strips being equivalent to a turn of a coil. To prevent the spirally wound foil strips from acting as an inductance and allowing leakage of unwanted electrical signals to the conductors 14 and 16, the foil strips terminate against themselves along the length of the shielding member, thus shorting each turn of the coil and eliminating the inductive effect.

In keeping with the present invention the use of the shielding member 26 as pictured in FIG. 2 has several advantageous attributes which make electric cables fabricated with the shielding member 26 ideal for certain specialty applications such as for use with aircraft circuitry. The inner electrical conductors are securely sealed from external moisture and vapors. Also the inner conductors are shielded by two closed concentric electrically conducting layers which provide excellent shielding. This allows a cable comprised of several cable circuits each wrapped in a separate shielding member to be fabricated which can easily be separated from each other and exhibit excellent cross-talk characteristics. Finally, since the shielding member does not bond to the insulation on the conductors, a portion of the shielding member can easily be removed for terminating the ends of the conductors.

Figure 4:
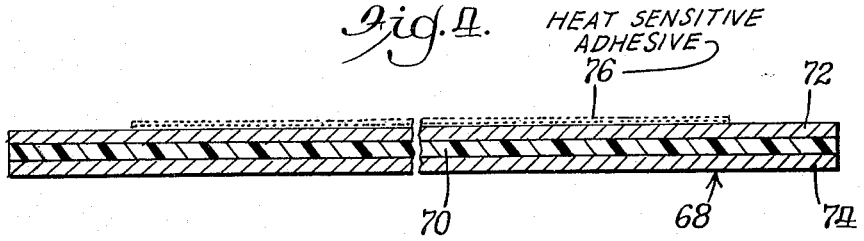
FIG. 4 is a cross-sectional view of another form of shielding member employed in cable structures of the present invention.

In accordance with another aspect of the present invention, a shielding member 68 is shown in FIG. 4 made of similar materials as shielding member 26, and comprising an elongated ribbon 70 of insulating material and a pair of elongated foil strips 72 and 74 arranged in a parallel relationship with the ribbon 70. Each of the foil strips 72 and 74 is bonded to an opposite side of the ribbon 70 and each has a width which is approximately equal to the width of the ribbon 70. Extending along the length of the center portion of the exposed surface of the foil strip 72 is a coating of heat sensitive sealing material 76 which is capable of bonding to the metallic foil strips 72 and 74.

Figure 5:
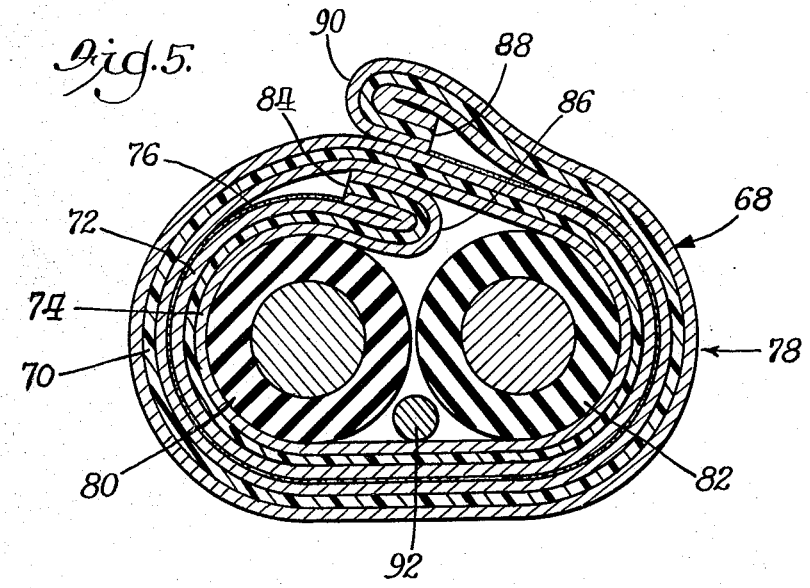
FIG. 5 is a cross-sectional view of an electric cable containing the shielding member in FIG. 4.

Referring to FIG. 5, a cross-sectional view of an electric cable 78 is shown wherein the shielding member 68 forms two connecting electrically closed shielding layers preferably helically twisted about a cable circuit consisting of insulated conductors 80 and 82. An outer elongated edge 84 of the shielding member 68 has a shorting fold 86 with an outer elongated edge of the foil strip 74 turned outward. Shielding member 68 then wraps completely around the pair of conductors 80 and 82 with the foil strip 74 facing inward. A middle portion of the foil strip 74 comes in contact with the shorting fold 86 and thereby forms a first metallic shielding layer which completely surrounds the pair of conductors 80 and 82. From this point the shielding member 68 wraps around the pair of conductors 80 and 82 a second time with the other outer elongated edge 88 of the shielding member 68 being folded inward in a shorting fold 90 so that the outer elongated edge of foil strip 74 comes in contact with a mid-portion of the foil strip 72. This creates a second metallic shielding layer which completely surrounds the first metallic shielding layer and the pair of conductors 80 and 82, with the metallic shielding layers connected to each other. The layer of sealing material 76 bonds a portion of the foil strip 72 to the foil strip 74 thus increasing the integrity of the seal and retarding moisture from reaching the pair of conductors 80 and 82. A drain wire 92 located within the inner shielding layer along the length of the cable 78 is provided for the reasons stated above.

It is noted that in order for the shielding member 68 to enclose the cable circuit within two connected concentric shielding layers it is not necessary for the shielding member 68 to extend completely around the cable circuit two full times as shown in FIG. 5. For example in FIG. 6 a shielding member 94 which is similar in construction to the shielding member 68 in FIG. 4 except it is not as wide and does not have a layer of heat sensitive sealing material, is wrapped about insulated conductors 96 and 98. An inner shorting fold 100 located along one elongated edge of the shielding member 94 is located close to an outer shorting fold 102 located along the other elongated edge of the shielding member 94. In this way the cable circuit is still enclosed within two connected concentric shielding layers, however, the absence of the heat sealing material does not prevent moisture from penetrating to the conductors 96 and 98. A drain wire 104 located within the inner shielding layer along the length of the cable is also provided for the reasons stated above.

Figure 6:
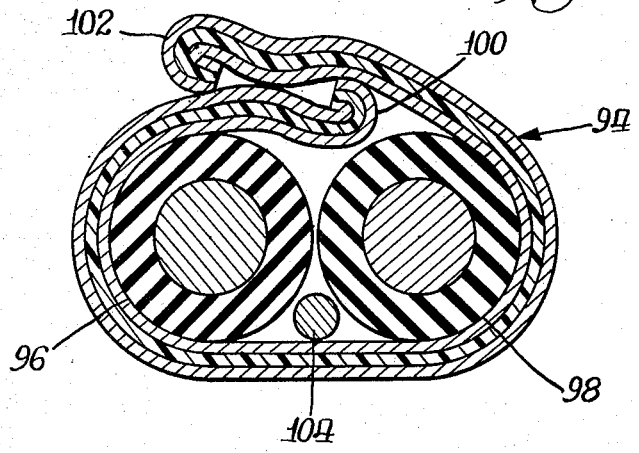
FIG. 6 is a cross-sectional view of another electric cable containing the shielding member in FIG. 4.

It is noted that for low frequency applications such as for the transmission of computer signals, it has been found that the configuration as shown in FIG. 3 provides better isolation of the cable circuit contained within the shielding member 26. However, for high frequency applications such as circuitry which are used to transmit radio frequency signals, it has been determined that the configuration as shown in FIGS. 5 and 6 provides better isolation of the cable circuit contained within the shielding members 68 and 94 respectively. At high frequency there are some resonant frequencies which bridge the metallic shielding layers causing leakage of external electrical signals into the cable circuit contained therein. The configuration as shown in FIGS. 5 and 6 wherein the metallic shielding layers are connected to one another retards this leakage. It is also noted that another way to retard this phenomenon while using the configuration of FIG. 3 is to use a ribbon of insulating material fabricated from an electrically lossy medium such as "Alathon" 2900, BK-50 semiconducting polyethylene resin manufactured by E. I. DuPont De Nemours & Company, which is a low-density polyethylene resin impregnated with carbon black.

From the foregoing, it should be appreciated that novel shielding members and electric cables comprised thereof have been described. Various configurations of the shielding member can be used to enclose a single cable circuit in two concentric metallic shielding layers fabricated from a single shielding member which provides excellent electrical isolation for the cable circuits contained therein. The selective use of a layer of heat sensitive sealing material for sealing the shielding layers protects the cable circuits from moisture.

It should be understood that although certain preferred embodiments of the present invention have been illustrated and described, various modifications, alternatives and equivalents thereof will become apparent to those skilled in the art and, accordingly, the scope of the present invention should be defined only by the appended claims and equivalents thereof.

Various features of the invention are set forth in the following claims.

What is claimed is:

1. A shielding member helically coiled about and for shielding at least one insulated electrical conductor, said helically coiled shielding member comprising: an elongated ribbon of insulating material having two opposite sides and two parallel edges; a pair of elongated metallic foil strips arranged in a parallel relationship with the ribbon, each strip having two opposite sides and two parallel edges, with a respective side of each strip bonded to a respective one of the opposite sides of the ribbon, one of the edges of one of the foil strips being substantially coterminus with one edge of the elongated ribbon, and one of the edges of the other of the foil strips being substantially coterminus with the other edge of the elongated ribbon, the width of each of the foil strips being approximately one half the width of the ribbon, and each of the other edges of the foil strips slightly overlapping one another, said ribbon being helically wound about said at least one insulated electrical conductor with each of said foil strips surrounding and forming a shielding envelope for at least one insulated electrical conductor; and a layer of adhesive on a portion of the exposed surface of the ribbon and extending along the length of the ribbon.

2. The combination of claim 1 wherein the layer of adhesive is heat sensitive.

3. The combination of claim 1 wherein the layer of adhesive substantially covers the exposed surfaces of the ribbon.

4. An electric cable comprising: a cable circuit comprising one or more conductors; a shielding member comprising an elongated ribbon of insulating material, and a pair of elongated metallic foil strips arranged in a parallel relationship with the ribbon and bonded to opposite sides of the ribbon, the width of each of the foil strips being less than the width of the ribbon, and each of the foil strips having an outer elongated edge generally in alignment with the opposite elongated edges of the ribbon, the shielding member being wrapped circumferentially around the cable circuit in a generally parallel relationship forming two concentric, substantially closed shielding layers, each of the layers being formed by a respective one of the foil strips with the foil strips not directly contacting each other; and an overlapping outer jacket.

5. The electric cable of claim 4 wherein the elongated ribbon is composed of an electrically lossy material.

6. The electrical cable of claim 4 or claim 5 wherein an inner elongated edge of each of the foil strips contacts an outer elongated edge of the respective foil strip along the length of the shielding member

7. The electric cable of claim 6 wherein the shielding member further comprises a layer of adhesive on a portion of the exposed surfaces of the ribbon for bonding one side of the exposed surface of the ribbon to the other side of the exposed surface of the ribbon along the length of the ribbon.

8. The electric cable of claim 7 wherein the layer of adhesive substantially covers the exposed surfaces of the ribbon.

9. The electric cable of claim 7 wherein the layer of adhesive is composed of a heat sensitive adhesive material.

10. The electric cable of claim 7 wherein the inner elongated edges of the foil strips extend over a common portion along the length of the ribbon in an offsetting relationship.

11. The electric cable of claim 7 wherein the adhesive material does not adhere to the outer jacket or to the cable circuit.

12. The electric cable of claim 4 wherein the shielding member is helically twisted about the cable circuit.

13. The electric circuit of claim 12 wherein the cable circuit comprises a pair of insulated conductors helically twisted about each other.

14. An electric cable comprising: at least one electrical conductor; an electrically shielding member including an elongated ribbon of insulating material having two opposite sides and two parallel edges, two metallic foil strips, said strips being carried on opposite sides of said ribbon, each of said edges being folded back upon itself with a portion of at least one of said foil strips thereon also being folded back, said shielding member being wrapped circumferentially around said at least one electrical conductor in a generally parallel relationship forming two concentric, substantially electrically closed shielding layers, each of the layers being formed by a respective one of said foil strips with said foil strips contacting each other at said folded back edges thereby electrically shorting said layers to each other, and an overlying outer jacket.

15. The electric cable of claim 14 further characterized in that the shielding member is helically twisted about said at least one electrical conductor.

16. The electric cable of claim 15 further characterized in that said at least one electrical conductor consists of a pair of insulated electrical conductors helically twisted about each other.

17. The electric cable of claim 14 further characterized in that said shielding member has a layer of adhesive for bonding a portion of one of said foil strips to a portion of said other foil strip along the length of said shielding member.

18. The electric cable of claim 17 further characterized in that said adhesive is heat sensitive.

19. The electric cable of claim 18 further characterized in that said adhesive does not adhere to said outer jacket or to said at least one electrical conductor.

* * * * *

UNITED STATES PATENT AND TRADEMARK OFFICE

CERTIFICATE OF CORRECTION

PATENT NO. : 4,327,246

DATED : April 27, 1982

INVENTOR(S) : J.M. Kincaid

It is certified that error appears in the above—identified patent and that said Letters Patent is hereby corrected as shown below:

Claim 4
Column 5, Lines 63 and 64
Specification, Page 12, line 14 "overlapping" should read --overlying--

Claim 6
Column 6, Line 6
Specification:
Claim 7, Page 12, Line 5 insert a period after member Claim 13
Column 6, Line 28
Claim 14
Column 13, Line 1 "circuit" should read --cable---

Signed and Sealed this

Fifth Day of October 1982

[SEAL]

*Attest:*

GERALD J. MOSSINGHOFF

*Attesting Officer* *Commissioner of Patents and Trademarks*